United States Patent [19]

Bubik et al.

[11] 4,071,401

[45] Jan. 31, 1978

[54] SEPARATING SYSTEM FOR SEPARATING TWO WIRES OF A DOUBLE-WIRE PAPER-MAKING MACHINE

[75] Inventors: Alfred Bubik, Ravensburg; Siegfried Reutter, Gerbertshaus; Hans-Joachim Schultz, Oberhofen; Wolf-Gunter Stotz, Ravensburg, all of Germany

[73] Assignee: Escher Wyss G.m.b.H., Ravensburg, Germany

[21] Appl. No.: 728,591

[22] Filed: Oct. 1, 1976

[30] Foreign Application Priority Data

Oct. 2, 1975 Switzerland ..... 12777/75

[51] Int. Cl.[2] ..... D21F 1/40

[52] U.S. Cl. ..... 162/300; 162/306; 162/307; 162/352

[58] Field of Search ..... 162/203, 300, 301, 302, 162/303, 306, 307, 352, DIG. 7

[56] References Cited

U.S. PATENT DOCUMENTS

| | | | |
|---|---|---|---|
| 2,780,968 | 2/1957 | Heys | 162/358 |
| 2,911,039 | 11/1959 | Hornbostel et al. | 162/303 |
| 3,023,805 | 3/1962 | Walker | 162/306 X |
| 3,262,841 | 7/1966 | Embry | 162/301 |
| 3,726,758 | 4/1973 | Parker et al. | 162/303 X |
| 3,981,084 | 9/1976 | Sobota | 162/307 X |

*Primary Examiner*—Richard V. Fisher

*Attorney, Agent, or Firm*—Kenyon & Kenyon, Reilly, Carr & Chapin

[57] ABSTRACT

The auxiliary roll of the separating system is located downstream of the main roll and is spaced from the main roll at a distance less than 0.25 times the diameter of the auxiliary roll and greater than the combined thickness of the two wires and paper web therebetween, e.g. a distance of 10 millimeters. A separating wall is located between the main roll and main wire on the upstream side to block the entry of air between the main wire and main roll. The spacing of the two rolls ensures a positive separation of the paper web on the main wire.

12 Claims, 4 Drawing Figures

SEPARATING SYSTEM FOR SEPARATING TWO WIRES OF A DOUBLE-WIRE PAPER-MAKING MACHINE

This invention relates to a separating system for separating two wires of a double-wire paper-making machine.

As is known, various types of separating systems have been known in double wire paper making machines. For example, as described in U.S. Pat. No. 2,911,039, a system is known wherein two wires are fed to the separating system together with a paper web between them. This separating system includes a main roll over which a main wire is trained with a web of paper thereon and an auxiliary roll for an auxiliary wire. The auxiliary roll is situated after the main roll as considered in the direction of movement of the wires and is so disposed that the auxiliary wire trained thereover separates from the main roll earlier than the main wire; the surface of the auxiliary roll being spaced from the surface of the main roll.

However, in this known separating system, the main roll is a suction roll with a foraminous barrel. The purpose of this is to ensure that the paper web adheres to the main wire at the separating point and is not entrained by the auxiliary wire. The disadvantage of the suction roll, however, is that it is expensive. The suction roll also consumes a considerable amount of energy and is noisy in operation.

In the known separating system according to U.S. Pat. No. 2,911,039, the main roll is followed, as considered in the direction of movement of the wires, by another solid roll over which the auxiliary wire is trained. However, this roll is so far away from the main roll that it cannot influence the separating process.

Accordingly, it is an object of the invention to provide a separating system of the above kind but which is simpler than the known separating system and also has a minimum energy consumption when in operation.

Briefly, the invention provides a separating system for two wires in a double wire paper making machine which includes a main wire, an auxiliary wire for conveying a paper web with the main wire in a given direction, a main roll having a solid circumferential surface with the main wire trained thereon and an auxiliary roll having the auxiliary wire trained thereon. The auxiliary roll is disposed downstream of the main roll relative to the direction of travel of the paper web and is spaced from the main roll at a distance less than 0.25 times the diameter of the auxiliary roll and greater than the combined thickness of the wires and paper web.

The use of a main roll with a solid surface results in an adhesive effect on the paper web. This effect is known as the register roll effect wherein in the case of a wet paper web and a main wire whose apertures are filled with water, the paper web adheres to the wire with a certain force. In machines having high wire speeds, such as is frequently the case with double-wire machines, this force would not be sufficient to ensure satisfactory transfer of the paper web to the main wire. It is for this reason that the suction roll is provided in the known separating system.

According to the invention, however, the auxiliary roll is utilized for this purpose. Since the auxiliary roll is disposed near the main roll, the flow of the air entrained by the auxiliary roll is used to assist the lifting of the paper web away from the auxiliary wire. Thus, a dynamic pressure forms under the influence of the air entrained by the roll in the wedge-shaped space between the auxiliary roll surface and the auxiliary wire running on to the auxiliary roll. This pressure assists the removal of the web of paper from the auxiliary wire.

Preferably, the distance between the surface of the auxiliary roll and the surface of the main roll may be less than ten millimeters (mm). Consequently, the spacing between the two rolls allows the dynamic pressure formed by the auxiliary roll to take full effect.

A separating wall may be disposed between the main roll and the main wire on the main roll entry side to extend substantially from the surface of the main roll to the wire in order to close the intermediate space between the main roll and the main wire. This step prevents the formation of a dynamic air pressure in the space between the surface of the main roll and the main wire such as might interfere with the separating process.

The end of the partition facing the wire may have a stripper edge for surplus water on the wire. This step ensures removal of the water which is suspended from the wire and which, on penetration into the wedge space, would be forced back into the wire and might also interfere with the separating process.

The auxiliary roll preferably has a smaller diameter than the main roll.

The distance between the axis of the auxiliary roll and the axis of the main roll as considered parallel to a portion of the auxiliary wire between the rolls may be 0.03 to 0.5 times the diameter of the auxiliary roll. The full action of the dynamic pressure of the air entrained by the auxiliary roll is also assisted at the separating point by this.

Preferably, the loop angle of the auxiliary wire at the auxiliary roll may be a maximum of 90°. This allows an air flow to form at the periphery of the auxiliary roll to form the dynamic pressure without obstruction by the auxiliary wire.

The auxiliary roll may have a solid surface. A construction of this kind, which is in most cases sufficient, is simple and cheap and uses less propulsion energy during operation. The surface of the auxiliary roll may alternatively be roughened to increase the dynamic pressure by entrained air.

Alternatively, the auxiliary roll may have a surface provided with blind recesses. Thus, even if the main roll and auxiliary roll surfaces are close together, air transport through the narrowest point between the rolls is possible. This compensates somewhat for the pressure at and after the wire separating point. More air is also entrained by a roll surface construction of this kind than a smooth surface.

Finally, for maximum requirements, the auxiliary roll may have an apertured surface allowing air to flow from the interior of the roll downwardly. With a roll of this kind, a radial air flow forms under the influence of centrifugal force and not only facilitates the lifting of the auxiliary wire off the paper web but, in addition, presses the paper web against the main wire after the separating point. This avoids the possible risk of the paper web lifting away from the main wire.

These and other objects and advantages of the invention will become more apparent from the following detailed description and appended claims taken in conjunction with the accompanying drawings in which:

Figure 1:
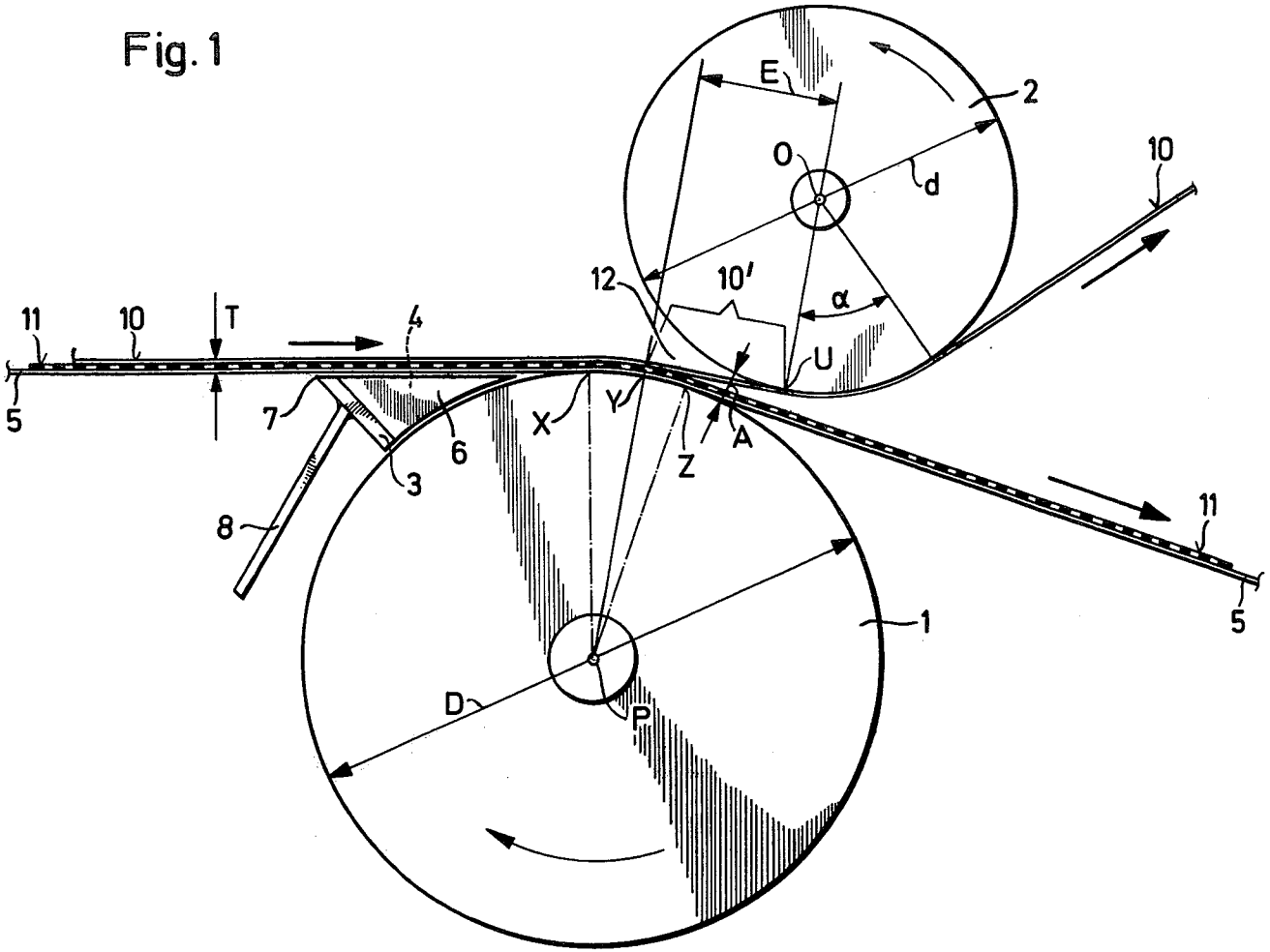
FIG. 1 illustrates a detail of a double-wire paper-making machine showing a separating system according to the invention.

Referring to FIG. 1, the separating system comprises a main roll 1 having a diameter D, an auxiliary roll 2 having a diameter *d* and a separating wall 3 for closing a wedge-shaped space 4 between the surface of the main roll 1 and a main wire 5 trained onto the main roll 1. The separating wall 3 has side walls 6 which are intended to render the inflow of air from the side difficult. The separating wall is provided with a stripper edge 7 at the end facing the main wire 5 to strip surplus water on the main wire 5. A baffle 8 is also connected to the wall 3 in order to keep away from the surface of the main roll 1 any water stripped off by the stripper edge 7.

Together with the main wire 5, an auxiliary wire 10 is also fed substantially rectilinearly to the rolls 1, 2. A web of paper 11 shown by a broken line is situated between the wires 5 and 10. The two wires 5, 10 together with the web 11 may come from a sheet forming zone which, for example, may also be constructed in known manner in accordance with U.S. Pat. No. 2,911,039.

As will be clear from the drawing, the surfaces of the main roll 1 and of the auxiliary roll 2 are at a distance A from one another. Also, the axis 0 of the auxiliary roll 2 as considered in a direction parallel to a portion 10' of the auxiliary wire 10 between the rolls 1, 2 is at a distance E from the axis P of the main roll 1.

As shown, the auxiliary wire 10 is trained over the auxiliary roll 2 to form a loop angle $\alpha$ . In the embodiment illustrated as an example, the diameter *d* of the auxiliary roll 2 is smaller than the diameter D of the main roll 1. The distance A between the surfaces of the rolls 1 and 2 is less than 0.25 times the diameter *d* of the auxiliary roll 2, but larger than the thickness T of the wires 9, 10 and of the paper web 11 together. The distance E is 0.03–0.5 times the diameter *d* of the auxiliary roll 2. The loop angle $\alpha$ of the auxiliary wire 10 is less than 90° and, as shown, is approximately 45°.

During operation, the wires 5, 10 together with the web of paper 11 move at a speed of 2000 meters per minute and more in relation to the two rolls 1 and 2. The stripper edge 7 strips any water escaping downwardly from the wire 5 and prevents the water from penetrating into the wedge space 4. The separating wall 3 prevents a pressure from being formed by the air entrained by the surface of the main roll 1.

The two wires 5, 10 run on to the main roll 1 at a point X, the auxiliary wire 10 leaves the main roll 1 at a point Y and the main wire 5 is lifted from the surface of the main roll 1 at a point Z.

In the embodiment illustrated, a dynamic pressure forms in a wedge space 12 between the surface of the auxiliary roll 2 and the position 10' of the wire 10 as may develop under the influence of the air entrained by the surface of the auxiliary roll 2. The air movement required to form this dynamic pressure is further assisted by the fact that the loop angle $\alpha$ of the auxiliary wire 10 is relatively small, so that the surface of the auxiliary roll 2 can move freely in the air space.

A register roll effect which has an adhesive action acts during the movement of the main wire 5 between the points X and Z and a certain zone after the point Z. This adhesive effect retains the web of paper 11 on the main wire 5 and, with the main wire 5, on the surface of the main roll 1. As the wire 5 is lifted together with the paper web 11, a vacuum forms beneath the wire 5 so that the wire 5 has to be lifted against atmospheric pressure. The air pressure acting in the wedge space 12 also acts from above on the auxiliary wire 10 and assists separation of the paper web 11 from the auxiliary wire 10. Consequently, the paper web 11 is separated from the auxiliary wire 10 and advanced with the main wire 5 as required.

Figure 2:
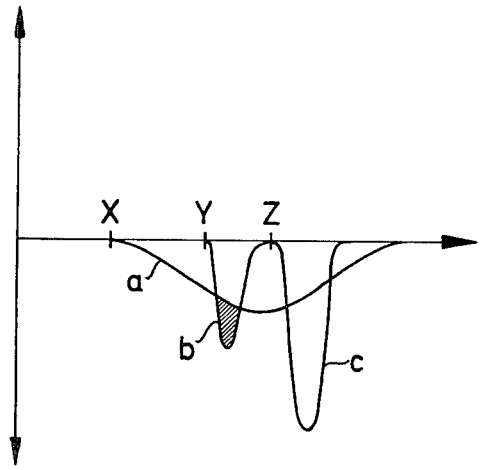
FIG. 2 illustrates a graph of the pressures in the region of the wire separating point.

FIG. 2 is a graph of the air dynamic pressure acting on the paper web 11 from above, and the lifting force applied to the paper web 11 at the lift-off point.

Referring to FIG. 2, the dynamic pressure curve is substantially as shown by the line *a*. The effect of the dynamic pressure starts approximately at the region of point X, is at the maximum in the region of point Z, and then declines.

The adhesion of the paper web 11 on the main roll 1 is shown by curve *b* while the lift-off force to which the paper 11 is subjected is shown by curve *c*. Along a short section after point Y, the paper web 11 is subjected to a lifting force which is shown by curve *b* and which counteracts the adhesive force and the dynamic air pressure. This is the critical point, because at this point it will be decided whether the paper web 11 moves along the wire 5 or along the wire 10. In the embodiment illustrated, the adhesive force is subjected only to the load shown by the shaded zone of the curve *b*, since the paper web 11 is pressed against the wire 5 by the dynamic pressure *a*.

Finally, after the lift-off point Z there is a second pressure peak shown by the curve *c*. This has a smaller influence on the separating operation, however, since the pressure holds the paper web 11 on the wire 5 and thus assists the separation process at point Y.

As already stated, the aerodynamic pressure as shown by curve *a* in FIG. 2 may be influenced by various constructions of the surface of the auxiliary roll 2.

Figure 3:
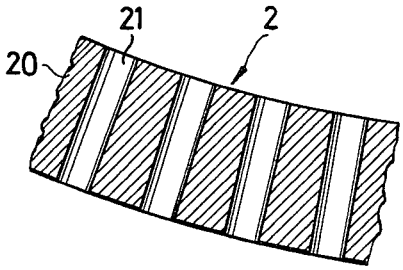
FIG. 3 illustrates a detail of a barrel of an auxiliary roll formed with continuous bores.

Referring to FIG. 3, the auxiliary roll 2 may have a barrel 20 formed with continuous bores 21. These bores 21 enable air to flow radially from the interior of the roll 2 outwardly under the influence of centrifugal force. In this way, the roll 2 becomes a blow roll with simple means, the roll 2 acting on the paper web 11 with an air pressure from above. Of course, this air pressure can be much higher than a dynamic pressure which would otherwise form in the case of a roll with a smooth surface.

To save propulsive power in a roll having a barrel 20 as shown in FIG. 3, that part of the roll periphery not required for the blowing process can be covered by a cover (not shown).

Figure 4:
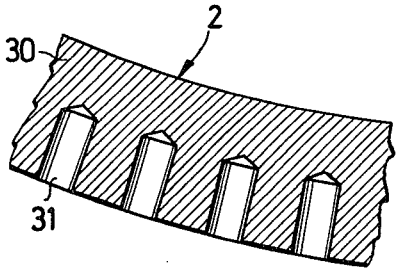
FIG. 4 illustrates a similar detail to FIG. 3 showing a barrel of an auxiliary roll but with blind bores forming pockets to receive air.

Referring to FIG. 4, the auxiliary roll 2 may alternatively have a barrel 30 formed with blind bores 31. These bores 31 are intended to receive air at superatmospheric pressure in the dynamic pressure zone 12 and to transport this air through the narrowest point between the rolls 1 and 2. This arrangment is suitable particularly when the space A between the rolls 1 and 2 is at a minimum and is only slightly in excess of the thickness T of the wires 5 and 10 with the web of paper 11. The bores 31 prevent the formation of a vacuum after the narrowest point between the rolls 1 and 2 which might cause the web of paper 11 to lift away from the wire 5.

What is claimed is:

1. A separating system for separating two wires in a double wire paper making machine comprising a main wire of a given thickness;

an auxiliary wire of a given thickness for conveying a paper web with said main wire in a given direction;

a main roll having a solid circumferential surface with said main wire trained thereon; and an auxiliary roll having said auxiliary wire trained thereon; said auxiliary roll being disposed downstream of said main roll relative to said direction and being spaced from said main roll at a distance less than 0.25 times the diameter of said auxiliary roll and greater than the combined thickness of said wires and said web whereby a conveyed paper web is separated from said auxiliary wire and advanced with said main wire during operation of said system.

2. A separating system as set forth in claim 1 wherein said distance is less than ten millimeters.

3. A separating system as set forth in claim 1 which further comprises a separating wall between said main roll and said main wire upstream of said main roll, said wall extending from the surface of said main roll to said main wire to close a space between said main roll and said main wire.

4. A system as set forth in claim 3 which further comprises a stripper edge on said separating wall at an end of said wall facing said main wire for stripping surplus water on said main wire.

5. A system as set forth in claim 1 wherein said auxiliary roll has a smaller diameter than said main roll.

6. A system as set forth in claim 1 wherein the distance between the axis of said auxiliary roll and the axis of said main roll parallel to a portion of said auxiliary wire between said rolls is 0.03 to 0.5 times the diameter of said auxiliary roll.

7. A system as set forth in claim 1 wherein said auxiliary wire has a loop angle at said auxiliary roll of no more than 90°.

8. A system as set forth in claim 1 wherein said auxiliary roll has a solid surface.

9. A system as set forth in claim 1 wherein said auxiliary roll has a surface with blind recesses.

10. A system as set forth in claim 1 wherein said auxiliary roll has a surface formed with apertures to allow air to flow outwardly from the interior of said auxiliary roll.

11. A separating system for separating two wires in a double wire paper making machine comprising a main wire of a given thickness;

an auxiliary wire of a given thickness for conveying a paper web with said main wire in a given direction;

a main roll having a solid circumferential surface with said main wire trained thereon;

an auxiliary roll having said auxiliary wire trained thereon; said auxiliary roll being disposed downstream of said main roll relative to said direction and being spaced from said main roll at a distance less than ten millimeters and greater than the combined thickness of said wires and said web whereby a conveyed paper web is separated from said auxiliary wire and advanced with said main wire during operation of said system; and a separating wall between said main roll and said main wire upstream of said main roll, said wall extending from the surface of said main roll to said main wire to close a space between said main roll and said main wire.

12. A system as set forth in claim 11 wherein the distance between the axis of said auxiliary roll and the axis of said main roll parallel to a portion of said auxiliary wire between said rolls is 0.03 to 0.5 times the diameter of said auxiliary roll.

* * * * *

UNITED STATES PATENT AND TRADEMARK OFFICE

CERTIFICATE OF CORRECTION

PATENT NO. : 4,071,401

DATED : January 31, 1978

INVENTOR(S) : Alfred Bubik et al

It is certified that error appears in the above-identified patent and that said Letters Patent are hereby corrected as shown below:

Column 3, line 62, change "position" to -- portion --

Signed and Sealed this

*Ninth* Day of *May 1978*

[SEAL]

*Attest:*

RUTH C. MASON
*Attesting Officer*

LUTRELLE F. PARKER
*Acting Commissioner of Patents and Trademarks*